US007062856B2

(12) United States Patent
Moser

(10) Patent No.: US 7,062,856 B2
(45) Date of Patent: Jun. 20, 2006

(54) FOLDING TOOL

(75) Inventor: Rocky Moser, Exeter, CA (US)

(73) Assignee: United Cutlery Corporation, Sevierville, TN (US)

( * ) Notice: Subject to any disclaimer, the term of this patent is extended or adjusted under 35 U.S.C. 154(b) by 0 days.

(21) Appl. No.: 10/610,864

(22) Filed: Jun. 30, 2003

(65) Prior Publication Data

US 2004/0261272 A1 Dec. 30, 2004

(51) Int. Cl.
*B26B 3/06* (2006.01)

(52) U.S. Cl. ..... 30/160; 30/158; 30/159

(58) Field of Classification Search ..... 30/158, 30/159, 160, 161, 155
See application file for complete search history.

(56) References Cited

U.S. PATENT DOCUMENTS 4,442,600 A * 4/1984 Felix-Dalichow ..... 30/161
4,570,341 A * 2/1986 Konneker ..... 30/155
4,811,486 A * 3/1989 Cunningham ..... 30/158
4,837,932 A * 6/1989 Elsener ..... 30/159
5,044,079 A * 9/1991 Gibbs ..... 30/158
5,400,509 A * 3/1995 Collins ..... 30/155
5,461,786 A * 10/1995 Miller ..... 30/161
5,495,674 A 3/1996 Taylor, Jr.
5,511,310 A 4/1996 Sessions et al.
5,515,610 A 5/1996 Levin et al.
5,647,129 A 7/1997 Stamper
5,755,035 A 5/1998 Weatherly
5,781,950 A 7/1998 Swinden et al.
5,826,340 A * 10/1998 Hull ..... 30/160
5,839,194 A 11/1998 Bezold
5,915,792 A 6/1999 Sakurai
5,953,821 A 9/1999 Mearns
6,079,106 A 6/2000 Vallotton
6,145,202 A 11/2000 Onion
6,219,870 B1 4/2001 Swinden et al.
6,256,887 B1 7/2001 Osborne
6,308,420 B1 * 10/2001 Moser ..... 30/158
6,338,431 B1 1/2002 Onion
6,363,615 B1 4/2002 Moser
6,370,778 B1 4/2002 Conable
6,378,214 B1 4/2002 Onion
6,397,476 B1 6/2002 Onion
6,397,477 B1 6/2002 Collins
6,427,334 B1 8/2002 Onion
6,427,335 B1 8/2002 Ralph (Continued)

*Primary Examiner*—Stephen Choi
(74) *Attorney, Agent, or Firm*—Pitts & Brittian, PC

(57) ABSTRACT

A folding knife, comprising a blade pivotally connected to an elongate handle defining a recessed blade cavity and a blade opening assembly constructed and arranged to assist movement of the blade to an open position, in which the blade is extended. The blade opening assembly comprises, in one example, a bias element and an actuating member. The bias element is housed within the recessed blade cavity and has a free end. The actuating member is pivotally connected to the handle within the recessed blade cavity and is constructed and arranged to engage a portion of the tang of the blade and a portion of the bias element such that the blade may be assisted to the open position. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 C.F.R. § 1.72(b).

5 Claims, 4 Drawing Sheets

U.S. PATENT DOCUMENTS 6,430,816 B1 8/2002 Neveux
6,434,831 B1 8/2002 Chen
6,438,848 B1 8/2002 McHenry et al.
6,668,460 B1 * 12/2003 Feng ..... 30/161
2004/0154169 A1 * 8/2004 McCann ..... 30/161
2004/0231163 A1 * 11/2004 Sakai ..... 30/161

* cited by examiner

FOLDING TOOL

BACKGROUND OF THE INVENTION

1. Field of the Invention

This invention relates to folding tools, such as folding knifes, and more particularly to a mechanism for assisting the opening of a folding knife.

2. Background Art

Many types of folding tools are known. One well-known folding tool is the folding knife. One major concern of the user of a folding knife is the requirement of safely opening the knife to an open operative position. In the folding knife industry, there typically is provided a housing or handle for supporting the knife blade in the open position and for receiving the knife blade in the closed position. It is also known to cause the extended knife blade to be locked when in the open extended position. The present invention overcomes the deficiencies of folding knifes and opening mechanisms in the art by providing positive opening assistance to the user.

The present invention allows for the opening of the folding knife with only a single hand of the user, to the advantage of the general public. Further, because, in the present invention, the knife blade of the folding knife must typically be manually moved a certain distance, whereupon the mechanism of the folding knife serves to urge the blade into the open position without the application of further outside force by the user, the folding knife of the present invention may not be considered a switch blade, and hence, is legal in most jurisdictions of the United States.

SUMMARY OF THE INVENTION

The present invention relates to folding tools such as, for example, a folding knife. In one example, the folding knife has a blade, an elongate handle, and a bias element. The blade has tang at one end and has a cutting edge that extends along at least a portion of at least one side of the blade. The handle has a front end and a spaced back end. The handle also defines a recessed blade cavity therein. A pivot pin is provided for pivotally connecting the tang of the blade to the handle. In one example, the blade is pivotally connected to the handle proximate the front end of the handle so that the blade is rotatable about a rotational axis between an open position, in which the blade is extended, and a closed position, in which at least a portion of the cutting edge of the blade is disposed within the recessed blade cavity of the handle.

The blade opening assembly comprises a bias element and an actuating member. The bias element has a proximal end that is connected to a portion of the handle and a free end spaced from the proximal end. The bias element is housed within the recessed blade cavity of the handle. In one embodiment, the bias element lies substantially in a plane defined by the blade of the folding knife.

The actuating member is pivotally connected to the handle intermediate the tang of the blade and the bias element. Similar to the bias element, the actuating member is housed within the recessed blade cavity. In one embodiment, the actuating member may lie substantially in the plane defined by the blade. The actuating member has a peripheral edge surface defining a first arm and a second arm. In operation, a portion of the free end of the bias element engages the edge surface of the first arm of the actuating member and the second arm of the actuating member engages the tang of the blade such that the blade opening assembly assists movement of the knife blade to its open position.

In one example, the tang of the blade has an edge that defines a shoulder therein. At least a portion of the shoulder defines a drive surface. In use, the actuating member is movable between a first position, in which the blade is in its closed position, and a second position, in which a portion of the second arm of the actuating member contacts a portion of the drive surface of the shoulder to create a toggle point such that the blade is selectively locked in its open position. Further, the blade opening assembly exerts an opening force to urge the blade into the open position when the user manually moves the blade from its closed position to beyond an equilibrium position.

DETAILED DESCRIPTION OF THE DRAWINGS

DETAILED DESCRIPTION OF THE INVENTION

Figure 1:
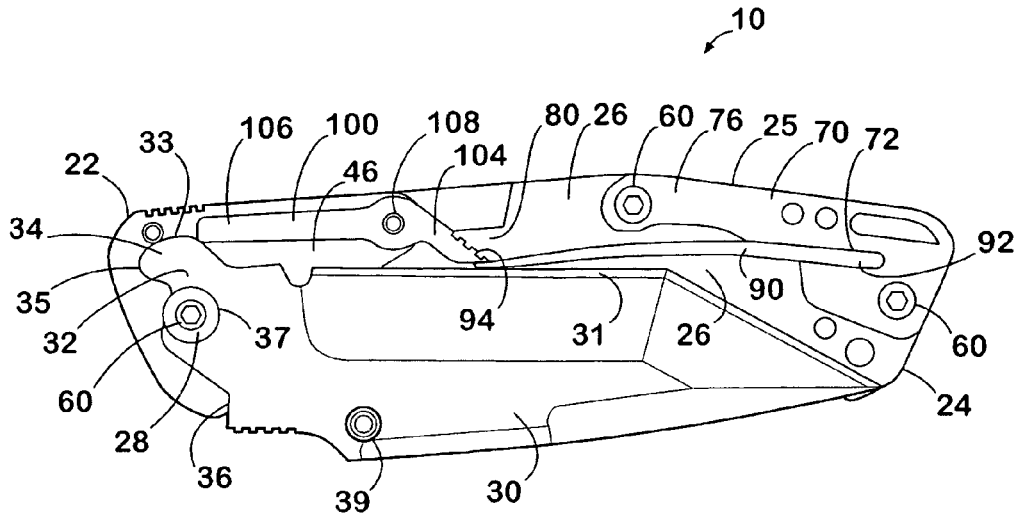
FIG. 1 is a partial cut-away side view of a folding knife in the closed position showing the construction and arrangement of a bias element and an actuating member housed within a recessed blade cavity of a handle when in its closed position.
Figure 2:
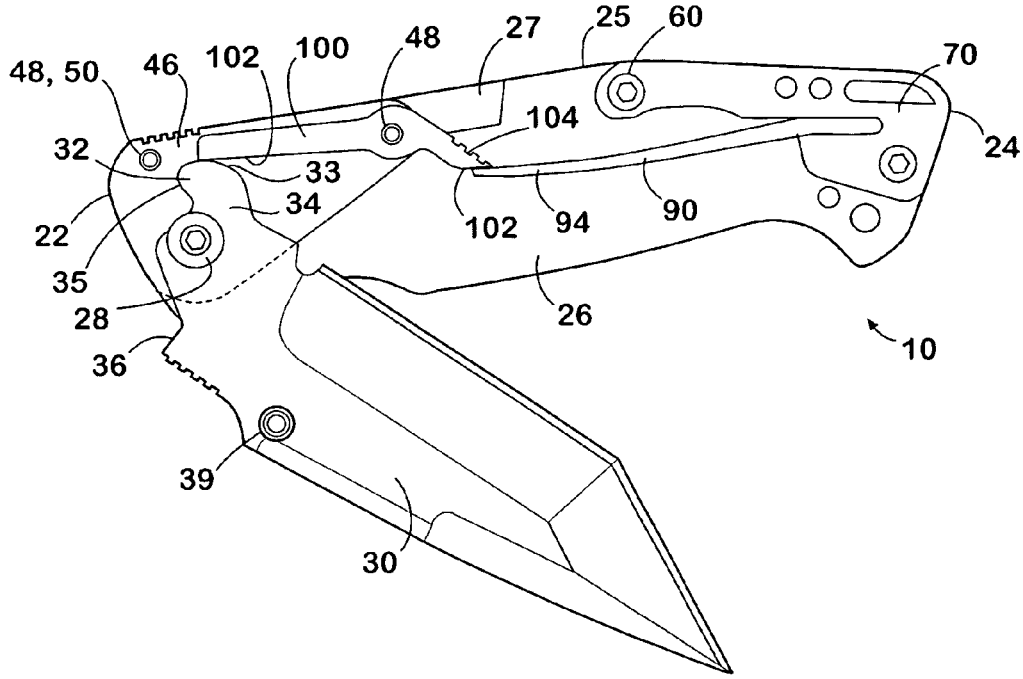
FIG. 2 is a partial cut-away side view of the folding knife of FIG. 1 with a knife blade being manually moved toward its open position.
Figure 3:
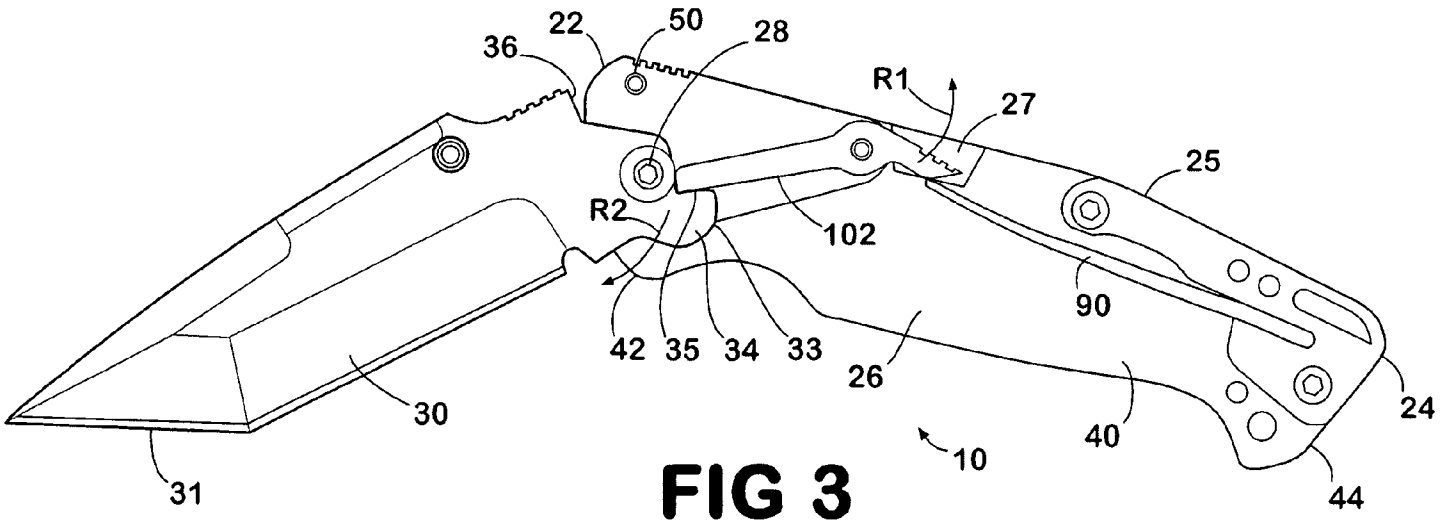
FIG. 3 is a partial cut-away side view of the folding knife of FIG. 1 with a knife blade being urged toward its open position by a blade opening assembly.
Figure 4:
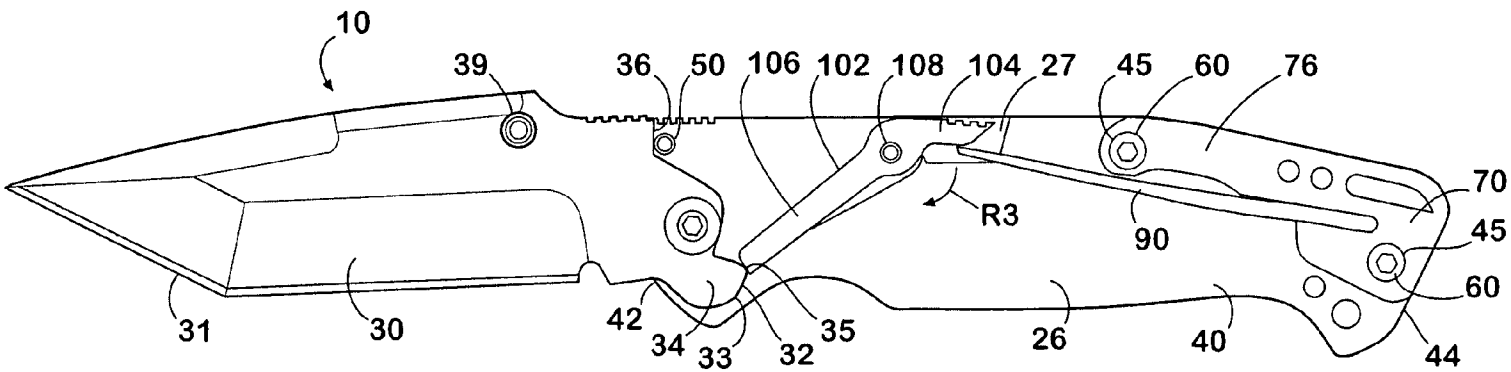
FIG. 4 is a partial cut-away side view of the folding knife of FIG. 1 with a knife blade in its open extended position showing the knife blade being selectively locked in its open position.
Figure 5:
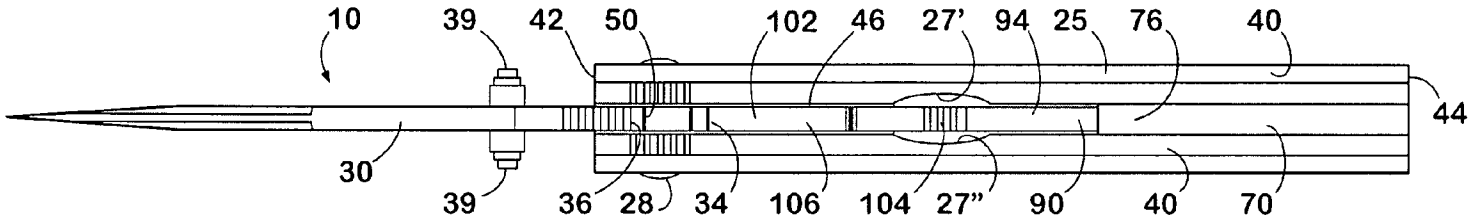
FIG. 5 is a top plan view of the folding knife in its open position.

The present invention is more particularly described in the following examples that are intended as illustrative only since numerous modifications and variations therein will be apparent to those skilled in the art. Thus, the embodiments of this invention described and illustrated herein are not intended to be exhaustive or to limit the invention to the precise form disclosed. They are chosen to describe or to best explain the principles of the invention and its application and practical use to thereby enable others skilled in the art to best utilize the invention. As used in the specification and in the claims, "a," "an," and "the" can mean one or more, depending upon the context in which it is used. The preferred embodiment is now described with reference to the figures, in which like numbers indicate like parts throughout the figures.

The invention relates to folding tools having a handle and a working portion in which at least a portion of the working portion is foldable within a portion of the handle when the tool is not in use. Accordingly, the term "folding knife" as used herein should also be understood to include other types of folding implements such as files, hand saws, and the like. Furthermore, those skilled in the art will appreciate that the device described herein, and its principles of operation and implementation, is broadly applicable to a wide variety of foldable implements generally and may be adapted to tools rather than knifes. Thus, while the present invention is hereinafter described with particular reference to a folding knife, the skilled artisan will note its many other applications.

Referring to the figures, a folding knife 10 is generally composed of a handle or casing, a blade opening assembly held within the handle or casing, and a blade 30. The handle has a front end 22 and a spaced back end 24.

In one embodiment, the handle has a pair of spaced opposing side members 40, each with a front end 42 and a back end 44. Each side member may also have an interior lining 46 positioned on at least a portion of the interior side of the side member. The side members 40 and, if used, the interior linings 46, define a recessed blade cavity 26 within the handle 20. The blade cavity is shaped so that at least a portion of the blade 30 may be disposed within the blade cavity when the blade is placed into a closed position. Each side member 40 has a plurality of openings 45 that receive conventional fasteners 60, such as for example, threaded screws, bolts, nuts, and the like, to secure the side members 40 in spaced relation to each other. The interior lining, if used, may have a plurality of holes 47.

The blade 30 has a cutting edge 31 along at least a portion of one side thereof and a tang 32 at one end. In one embodiment, the tang of the blade has a peripheral edge 33 that defines a shoulder 34 and a stop 36 therein. The shoulder is spaced from the stop. At least a portion of the shoulder 34 of the tang defines a drive surface 35.

The blade is rotatably mounted to the handle about a rotational axis. In one example, the blade is mounted on a pivot pin 28 extending between the side members 40 of the handle proximate the front end 22 of the handle. The tang defines a bore 37 constructed and arranged to receive the pivot pin 28. In one example, the pivot pin may be a conventional fastener. In operation, the blade is rotatable between the closed position, in which at least a portion of the cutting edge 31 is disposed within the blade cavity, and an open position, in which the blade is in an operative extended position.

The folding knife may also include a spacer member 70 constructed and arranged for disposition between the side members 40. In one example, the spacer member is connected to the handle proximate the back end of the blade cavity. The spacer member defines a slot 72 that extends generally toward the front end 22 of the handle when the spacer member is connected to the handle. The spacer member may also define an elongate portion 76 that extends generally toward the front end and at least partially along the upper edge of the handle when the spacer member is connected to the handle. The spacer member may be secured to the side members by conventional fasteners, adhesives, and the like. If conventional fasteners are used, the spacer member may have at least one bore 74 extending therethrough for operative receipt of at least a portion of the conventional fastener.

In addition, one of the side members may have at least one male projection 48 extending substantially normal to interior side of the side member and the other side member may have at least one female depression 49 constructed and arranged for receipt of the ends of the male projection. One of the male projections 48 proximate the front end of the handle may form a stop pin 50. The stop pin, by extending across the front end of the blade cavity, communicates with the stop 36 of the tang of the handle when the blade is positioned in the open, extended, position. In one example, at least one conventional fastener 60 is received within at least one of the holes 47 in the interior lining 46 and at least one male projection 48 is received within at least one of the holes of the interior lining. One will appreciate that each male projection 48 may be formed by a conventional fastener 60 that extends from one side member 40 to the other side member 40.

Figure 6:
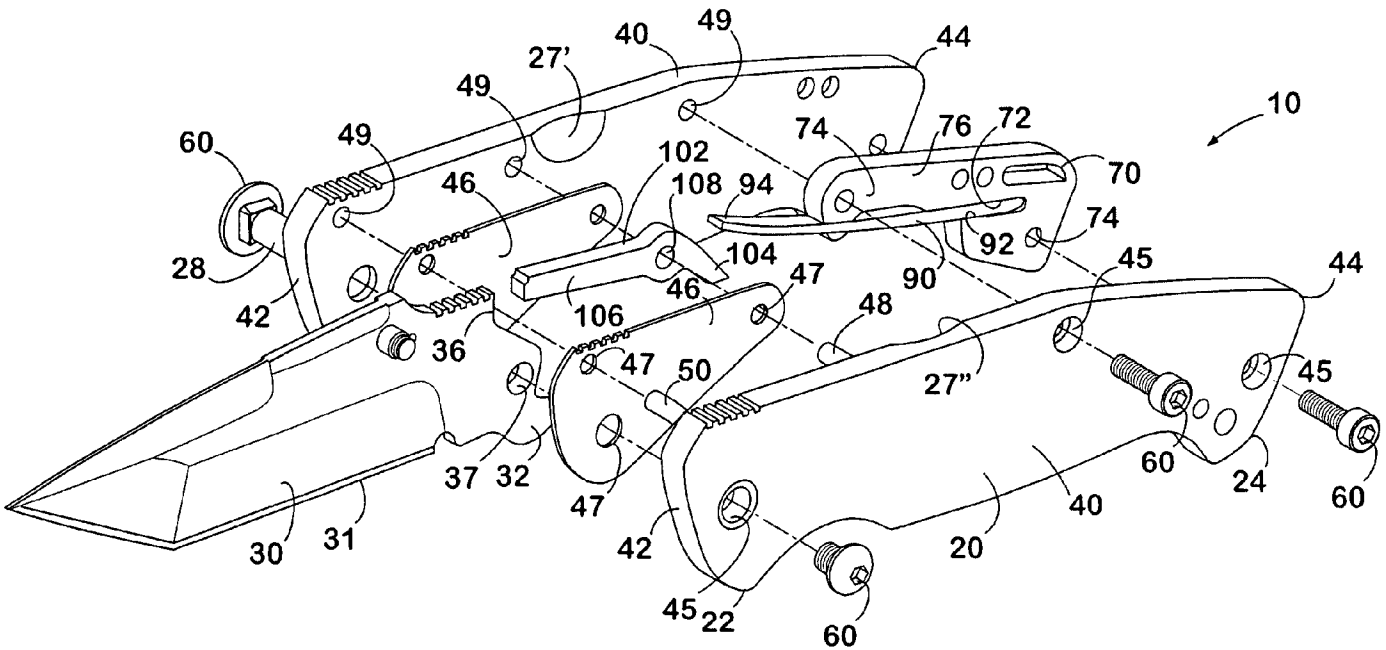
FIG. 6 is an exploded perspective view of the folding knife.
Figure 7:
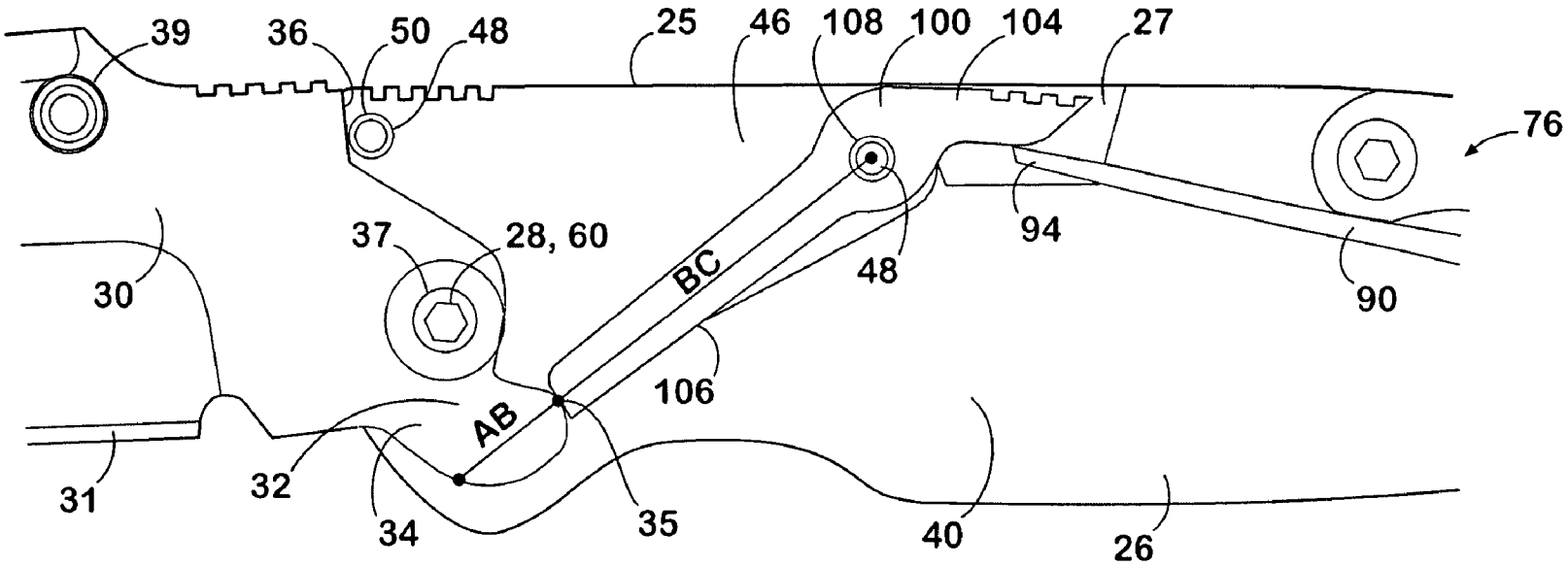
FIG. 7 is an expanded partial cut-away side view of the folding knife of FIG. 4.

The folding knife of the present invention houses a blade opening assembly 80 within the blade cavity 26. The blade opening assembly comprises a bias element 90 and an actuating member 100. The bias element 90 has a proximal end 92 that is connected to a portion of the handle and a free end 94 that is spaced from the proximal end. In one embodiment, the proximal end of the bias element is received within the slot 72 defined within the spacer member 70. When the bias element is received within the slot and the spacer member is connected proximate the back end of the handle, the free end 94 of the bias element extends generally toward the front end of the blade cavity. In one embodiment, a portion of the bias element may contact a portion of the elongate portion 76 of the spacer member when the actuating member is in a second position. As shown in FIG. 6, the bias element may be a conventional spring, such as, for example, a leaf spring, that is positioned within the blade cavity 26 so that the free end 94 of the bias element extends upwardly toward an upper edge 25 of the handle when the bias element is in an unloaded condition. Further, in one embodiment, the bias element 90 is housed within the blade cavity 26 such that the bias element lies substantially in a plane defined by the blade 30.

The actuating member 100 is pivotally connected to the handle intermediate the tang 32 of the blade and the spacer member 70. The actuating member has a peripheral edge 102 and defines a first arm 104 generally extending toward the back end of the blade cavity and a second arm 106 generally extending toward the front end of the blade cavity. The actuating member 100 also defines a bore 108 intermediate the first and second arms that is constructed and arranged to receive a male projection or a conventional fastener to allow for rotational movement of the actuating member. In one embodiment, the actuating member 100 is housed within the blade cavity 26 such that the actuating member lies substantially in a plane defined by the blade 30.

In operation, at least a portion of the second arm 106 of the actuating member is placed in continuous urging contact with a portion of the edge 33 of the tang 32 of the blade in response to a force applied to the first arm 104 of the actuating member by the bias element 90. At least a portion of the free end 94 of the bias element is in continuous urging engagement against a portion of the edge surface 102 of the first arm 104 of the actuating member.

The actuating member 100 is movable between a first position, in which the blade is in its closed position, and a second position, in which a portion of the second arm, such as, for example, its end, contacts a portion of the drive surface 35 of the shoulder 34 to create a toggle point, or dead point such that the blade may be selectively locked in its open position. In the open position, the blade is selectively locked in the open position as chord AB defined in the shoulder of the tang and longitudinal axis BC defined in the second arm of the actuating member are co-axial. In this configuration, a torque applied to the blade 30 by attempting to move the blade toward the closed position cannot induce rotation of actuating member 100 or the blade 30. In one embodiment, when the blade is in the open position and the actuating member is in its second position, the stop 36 of the tang of the handle contacts the stop pin 50, which aids in selectively locking the blade in the open position.

The bias element 90 and the actuating member 100 of the blade opening assembly 80 may assist in movement of the blade to the open position. In one embodiment, to open the blade, the knife 10 in a closed position is typically grasped with the back end 24 of the handle oriented toward the operator's wrist and the bottom edge of the handle resting the operator's palm. This allows the operator to use their thumb to engage the thumb extension 39 and apply rotational torque to the blade 30. The pressure applied by the operator onto the thumb extension 39 causes the blade to rotate about the pivot pin 28 and exit the blade cavity 26. When an equilibrium position is reached as the blade is lifted out of the blade cavity and the drive surface 35 of the blade rotates about the pivot pin 28 and with respect to the second arm 106 of the actuating member, the bias element and the actuating member exert an opening force onto the blade.

The tension in the bias element 90 acts against the actuating member 100 when a portion of the drive surface 35 of the tang is positioned at a certain critical angle relative to the rotational axis of the blade, which in turn forces the actuating member to act against the tang of the blade to cause the blade to quickly move to the open position. Beyond the equilibrium position, the first arm 104 is forced to move in a first rotation direction R1 due to a force vector applied by the tension applied by the bias element 90. This rotational movement of the actuating member 100 forces a portion of the second arm 106 of the actuating member into urging contact against a portion of the drive surface 35 of the tang, which, in turn, causes the tang 32 of the blade to rotate in a second rotational direction R2 until the blade 30 is in the open position and the actuating member 100 is in the second position. In one embodiment, the equilibrium position is reached when a portion of the drive surface 35 of the tang 32 is positioned overcenter relative to the rotational axis of the blade. It will be appreciated that the blade opening assembly 80 provides positive pressure to facilitate the movement of the blade to the open position. Only a limited amount of operator assistance is required, i.e., that required to move the blade to the equilibrium position.

To close the knife, the first arm 104 of the actuating member may be depressed by the operator, in a third rotational direction R3 that is opposite to the first rotational direction, to initiate movement of the actuating member from the second position to the first position. The initial movement of the actuating member 100 from the second position towards the first position spaces the portion of the second arm of the actuating member 100 from the portion of the drive surface 35 of the tang, which selectively disturbs or breaks the toggle point and, thus selectively unlocks the knife from its fully open position. The blade 30 of the knife can then by manually rotated by the operator into its closed position, which also places the actuating member 100 back into its first position.

In one embodiment, a portion of the edge surface 102 of the first arm 104 of the actuating member may be positioned proximate the upper edge 25 of the handle when the actuating member is in the second position to facilitate movement of the first arm 104 of the actuating member in the third rotational direction R3. The upper edge 25 of the handle may also define a female recess 27 in the upper edge. If side members are used, the female recess 27 may be formed by a pair of spaced female recesses 27', 27" that are positioned in opposition to each other (one of the pair of female recesses defined in the upper edge of each of the side members). The female recess 27 adjoins a portion of the blade cavity and is constructed and arranged so that the portion of the edge surface 102 of the first arm 104 of the actuating member is positioned within the female recess 27 when the actuating member is in the second position. Typically, in the second position the edge surface of the first arm will not extend beyond the plane defined by the upper edge of the handle. In operation, the operator simply presses a portion of the first arm 104 into the recess 27 to initiate closing the blade of the knife.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A folding knife, comprising:

a. a handle having a front end, an opposed back end, and a pair of spaced sides defining a blade cavity therebetween;

b. a blade having a cutting edge along at least a portion of at least one side thereof and a tang at one end, the tang having an edge having a shoulder defined therein, a portion of the shoulder defining a drive surface, the edge having a stop defined therein spaced from said shoulder, wherein the tang is rotatably mounted, about a rotational axis, between said sides of the handle proximate said front end such that the blade is rotatable between a closed position, in which at least a portion of the cutting edge of the blade is disposed within the blade cavity, and an open position, in which the blade is extended;

c. a stop pin connected to and extending between a portion of the sides of the handle proximate the front end of the handle and spaced from the rotational axis such that, in the open position, a portion of the stop of said tang contacts a portion of the stop pin;

d. a bias element having a proximal end and a spaced free end, said proximal end being connected to said handle;

e. an actuating member pivotally connected to said handle intermediate the respective front and back ends thereof, the actuating member having a first arm, a second and a peripheral edge surface, wherein at least a portion of the edge surface of the first arm is in continuous urging contact with at least a portion of the free end of the bias element, and wherein at least a portion of the edge surface of the second arm selectively remains in continuous urging contact with the edge of the tang of the blade, the actuating member being movable between a first position, in which said blade is in its closed position, and a second position, in which said blade is in its open position, and in which a portion of an end of said second arm contacts a portion of the drive surface of the shoulder to form a toggle point such that the blade is selectively locked in its open position.

2. The folding knife of claim 1, wherein a portion of the tang defines a chord extending through a portion of the drive surface thereof, wherein the second arm of the actuating member defines a longitudinal axis extending through the end of the second arm, and wherein, at the toggle point, the chord of the tang and the longitudinal axis of the second arm are coaxial so that rotational torque applied to the blade cannot induce rotation of the blade.

3. The folding knife of claim 1, wherein the stop contacts the stop pin when the actuating member is in the second position.

4. The folding knife of claim 1, wherein the bias element and the actuating member assist in movement of said blade to its open position.

5. The folding knife of claim 4, wherein the bias element and the actuating member exert an opening force when the blade is moved from its closed position to beyond an equilibrium position.

* * * * *